United States Patent [19]

Stinson

[11] Patent Number: 5,076,522

[45] Date of Patent: Dec. 31, 1991

[54] DETACHABLE FIELD MOUNT FOR ARROW QUIVERS

[76] Inventor: Robert E. Stinson, 7292 Peaceful Valley Rd., Acme, Mich. 49610

[21] Appl. No.: 537,819

[22] Filed: Jun. 14, 1990

[51] Int. Cl.[5] ..... A47K 1/00

[52] U.S. Cl. ..... 248/216.1; 124/23.1; 124/88; 248/217.4

[58] Field of Search ..... 248/216.1, 216.4, 217.4, 248/309.2; 124/88, 89, 23.1, 25.7; 33/265

[56] References Cited

U.S. PATENT DOCUMENTS

| | | | |
|---|---|---|---|
| 1,953,860 | 4/1934 | Kraatz | 248/216.1 X |
| 2,437,779 | 3/1948 | Carpentier | 248/216.1 X |
| 2,460,568 | 2/1949 | Buehner | 248/216.1 |
| 3,333,555 | 8/1967 | Kapnek | 248/217.4 X |
| 4,156,496 | 5/1979 | Stinson | 248/221.3 X |
| 4,704,800 | 1/1987 | Stinson | 124/25.7 X |

FOREIGN PATENT DOCUMENTS

| | | | |
|---|---|---|---|
| 0545158 | 3/1931 | Fed. Rep. of Germany | 248/216.1 |
| 1439757 | 6/1976 | United Kingdom | 248/217.4 |

*Primary Examiner*—Ramon O. Ramirez

*Attorney, Agent, or Firm*—Price, Heneveld, Cooper, DeWitt & Litton

[57] ABSTRACT

A field mount for arrow quivers includes a support base having a generally rigid body of a size and shape to be readily held in the hand of the user and a pointed attachment member for mounting the body upon a desired support found in the field, the attachment member being carried by the body to project transversely therefrom. The body includes means for receiving portions of the attachment member and for transmitting manually-applied mounting forces thereto, so that the pointed attachment member may be made to pierce and enter a desired external support. The support base has arrow quiver-mounting carried thereon for removably receiving quiver-mounting structure, whereby the readily-carried and manually-mounted support base may readily be used to detachably mount an arrow quiver for use while hunting in the field.

17 Claims, 2 Drawing Sheets

DETACHABLE FIELD MOUNT FOR ARROW QUIVERS

BACKGROUND OF THE INVENTION

Bow hunters and other archery enthusiasts have for many years had a variety of different bow-mounted arrow quivers available to them, which make it easier to carry extra arrows. This is particularly desirable for hunting purposes, while stalking or waiting in a blind for game, since such quivers are carried integrally with the bow and are thus immediately accessible for rapidly withdrawing additional arrows in the event fast second or third shots are necessary. A preferred such quiver and bow-mounting apparatus is that depicted in U.S. Pat. No. 4,156,496, which constitutes an earlier invention by the inventor herein.

Many bow hunters use blinds which they have built from logs, branches, and other natural materials found in the woods, and many utilize elevated blinds, e.g., platforms or other such structures secured in trees at some position elevated above the ground. These are particularly advantageous since most game, in particular larger animals such as deer and the like, are not thought to be upwardly observant, largely concentrating their surveillance to a horizontal line of sight. Thus, although extremely wary by nature, game such as deer and the like are known to frequently walk directly beneath a hunter occupying an elevated blind, for example in a tree.

In either event, and regardless of whether or not the hunter's blind is elevated, most hunters would prefer to have their bows unencumbered by quivers and spare arrows were it not for the desirability of having extra arrows immediately available in the shortest possible time. Accordingly, hunters who use blinds frequently wish to remove their bow-mounted quivers and to fasten them in some manner at a relatively convenient position upon some part of the blind which they are occupying. In order to accomplish this goal, hunters have resorted to many different forms of mounting means for their quivers, often securing them to or hanging them upon some part of the blind itself, e.g., tree branches, etc. Of course, it is not surprising that such rudimentary devices usually provide less than complete satisfaction, since they are likely to be makeshift in nature and are frequently laborious or tedious to fashion or implement, particularly under actual hunting circumstances and conditions in which inclement weather, low temperatures and the like are often present.

At times, such efforts to mount the hunter's quiver upon some part of the hunting blind is done in such a rudimentary manner that the quiver is not at all secure and will inadvertently loosen and fall to the ground, particularly during the excitement of shooting at game, which is, of course, the time when it is most inconvenient. At other times, as where a hunter has a favorite and frequently-used blind or stand, a more permanent securement will be utilized, e.g., screws or nails, which normally result in a semi-permanent installation. Of course, this requires that the hunter either leave his mounting brackets, etc., in position at all times, during the long intervals when hunting is not actually taking place, or else carry the necessary tools and equipment into the woods each time he goes to the blind, which is obviously cumbersome, laborious and generally undesirable.

SUMMARY OF THE INVENTION

The present invention provides a novel and useful solution to the foregoing problem, in the form of a simple yet durable and readily-usable apparatus which the hunter can easily carry in his pocket and readily install at a blind or stand, regardless of weather conditions and the like. Furthermore, the novel apparatus in accordance with the invention provides a readily-detachable quick-disconnect mount for a quiver of the bow-mounted type, utilizing a mounting device which may be left in place if desired, whether for only a brief interval or for a longer period of time, during which the hunter may mount and dismount his quiver in a simple and rapid manner while hunting from the same blind over a period of several days. Furthermore, the novel mounting apparatus in accordance herewith is readily detachable in a simple and effective manner, and may easily be carried from the field when hunting is over.

Accordingly, a major object and advantage of the invention is to provide a field mount for arrow quivers which is of simplified structure and of paratively few parts, which may be easily carried to the blind or stand, and which is readily and rapidly installed, as well as removed, at the blind or stand where hunting is to take place. In addition, the field mount of the invention provides integral, self-contained means for mounting it upon trees and the like, so that no additional tools need be brought into the field to weigh down the hunter's coat and make subsequent hunting actions cumbersome or inconvenient. In addition, the apparatus in accordance herewith is extremely durable and comparatively inexpensive in nature and structure, to further facilitate its manufacture and use.

Summarily stated, the field mount for arrow quivers in accordance with the invention comprises a support base having a generally rigid body of elongated configuration, which is adapted to be held in the hand and/or carried upon the person, in pockets and the like, together with a pointed attachment member which is, or can be, carried by the support base and which projects transversely therefrom, to mount the support base upon a desired external object such as a tree or the like. The support base includes means defining a recess for receiving portions of the attachment member, and for transmitting mounting forces thereto generated by the hand of the user, such that the pointed attachment member may be made to pierce and enter a desired support structure encountered in the field while hunting. The apparatus further includes a quiver-mounting means which is adapted to be secured to the support base, and which includes structure complimentary to that carried by the quiver-mounting means, by which a quiver may be removable received and carried thereupon, thereby removable mounting the quiver upon the support base.

BRIEF DESCRIPTION OF THE DRAWINGS

The foregoing major objects and advantages of the invention will be further understood by reference to the attached drawings depicting a preferred embodiment of the invention, in which.

DETAILED DESCRIPTION OF THE PREFERRED EMBODIMENT

Figure 1:
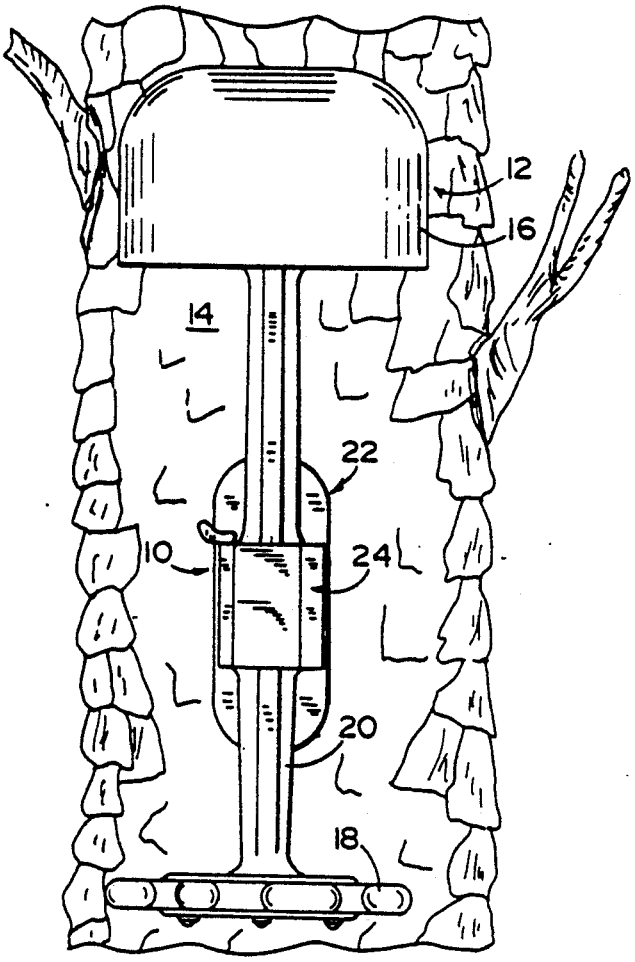
FIG. 1 is a pictorialized front elevational view showing a quiver mounted upon a tree trunk in accordance with the invention.
Figure 2:
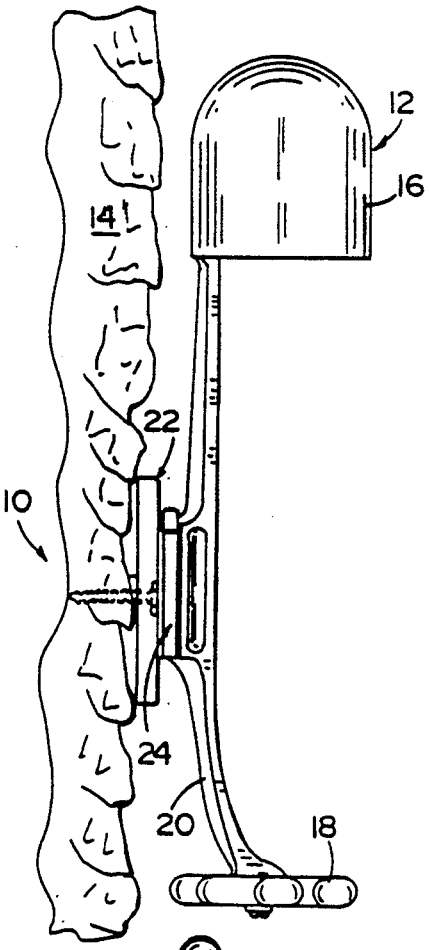
FIG. 2 is a side elevational view of the structure shown in FIG. 1, further illustrating the subject matter thereof.

As generally illustrated in FIGS. 1 and 2, the novel field mount 10 in accordance with the invention is utilized to mount a quiver 12 (preferably, a bow-mount quiver of the type shown in U.S. Pat. No. 4,156,496, as noted above) upon a tree trunk, branch or the like designated generally by the numeral 14. As is generally well-known, a quiver such as that designated by the numeral 12 typically includes a dome-like broadhead shield 16 for protectively covering the sharp arrow tips (which are likely to be multiple-bladed broadheads), together with a shaft-gripping arrow holder 18 at the base, interconnected by support 20 extending therebetween by which the quiver is mounted upon the bow handle. For a more detailed description of such a quiver, reference is made to Applicant's above-noted previous U.S. Pat. No. 4,156,496, which is to be deemed incorporated herein.

The field mount 10 in accordance herewith comprises a support base portion 22 and a quick-release quiver-mounting means 24, which preferably comprises a mounting bracket of the type shown in Applicants aforementioned prior U.S. Pat. No. 4,156,496, utilized in the particular manner, and with the preferred structure, described hereinafter. It is to be noted, however, that this particular mounting bracket is merely the preferred one, and that numerous others may also be used, as explained more fully hereinafter.

Figure 3:
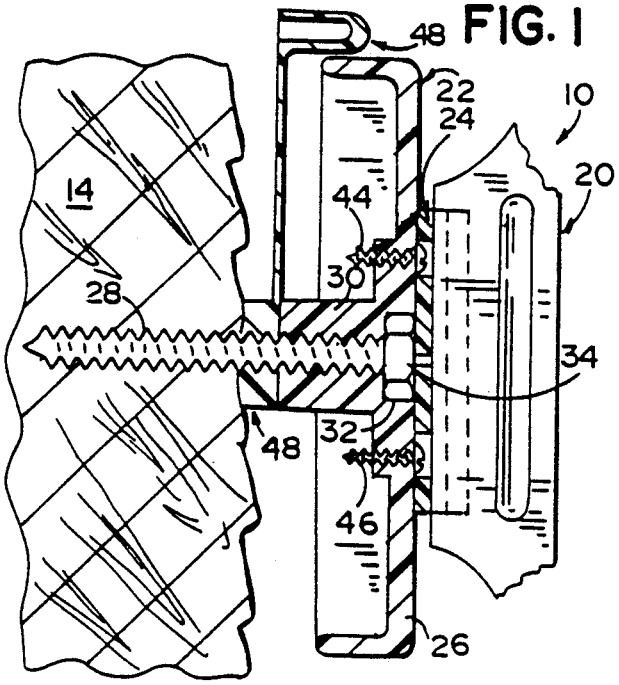
FIG. 3 is an enlarged, fragmentary, cross-sectional side elevational view, similar to FIG. 2, showing further details of the structure involved.
Figure 4:
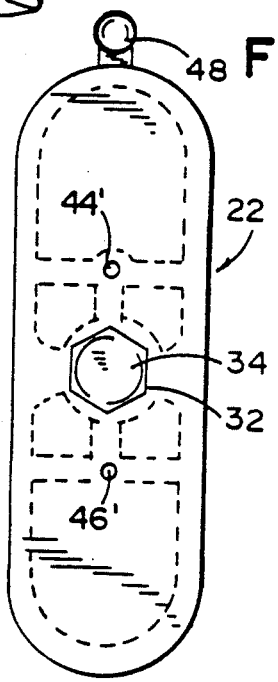
FIG. 4 is a front elevational view of the support base portion of the apparatus.
Figure 5:
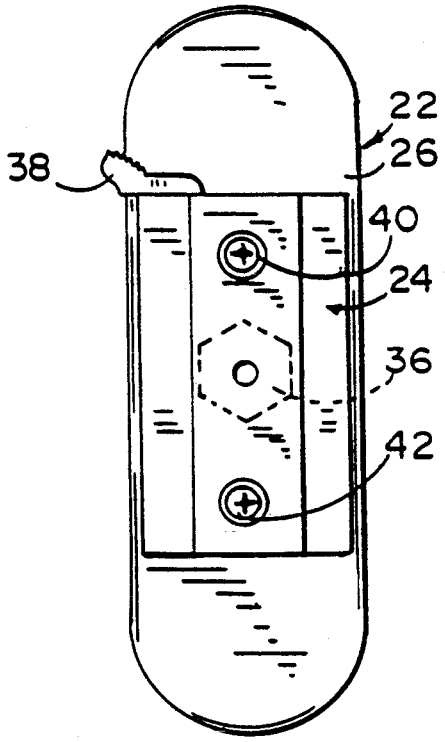
FIG. 5 is a front elevational view of the support base together with the preferred quiver-mounting means assembled and mounted therewith.

Referring now to FIGS. 3, 4 and 5, the support base 22 of the novel field mount 10 preferably comprises an elongated body 26 which is of a generally rigid nature and which is preferably a rearwardly-dished molded member formed from a generally rigid injection-moldable polymeric material such as nylon or the like, the dished form of which promotes structural strength and rigidity while at the same time reducing total weight and cost of materials. The body 26 is preferably of a size and shape which is readily holdable in the human hand, e.g., approximately four or five inches long and one inch wide, in accordance with which the body may be used as a manual tool to install the device upon a desired external support means, e.g., tree trunk or the like, by means of a pointed attachment member 28, preferably comprising a lag screw, which in a particular preferred embodiment may be approximately two inches long.

More particularly, the body 26 has a centrally-disposed hub portion 30 which has an axially-extending passage (not specifically identified) through which the aforementioned lag bolt or attachment member 26 may extend. Preferably, this passage includes an enlarged portion 32 (FIG. 3) through which the screw or member 28 is initially inserted, which furthermore defines an integral driving member, e.g., a hex socket in instances where the member 28 comprises a lag screw having a hex head 34. Of course, suitable attachment means of other particular natures may be utilized without departing from the spirit of the invention, but in any event it is desirable to have the body 26 implement a corresponding driving means (and it should be understood that the body or support base may take other specific forms and shapes, or be otherwise manufactured, without departing from the invention, providing that the same ends are served).

The preferred quick-release quiver-mounting means 24, as noted above, preferably comprises a bracket in accordance with Applicant's previous U.S. Pat. No. 4,156,496, which is hereby incorporated by reference. As shown in more detail in such patent, such a mounting means comprises a block-like member 24 having a vertically-extending T-slot 36, which is downwardly-tapered or else at least partially blind-ended, so that a correspondingly-shaped T-section flange carried by the quiver support beam 20 may readily slide downwardly into the bracket in order to mount the quiver thereupon. This preferred quiver-mounting bracket provides a thumb latch 38, preferably in the form of a manually-deflectable leaf spring element, for entrapping the mounting flange of the quiver within T-slot 36, thereby securing the quiver in place upon its mount.

It is to be noted that the mounting bracket 24 is preferably secured in place upon the body 26 by means of a pair of spaced apertures 40, 42, extending through the mounting bracket 24, together with correspondingly-spaced apertures 40' and 42', extending through the body 26, the latter two of which may be internally threaded. Thus, bevel-headed machine screws 44 and 46 (FIG. 5) may be utilized with correspondingly-countersunk inlets to apertures 40 and 42 to attach the mounting bracket 24 to the body 26, while at the same time maintaining the T-slot 36 in an unobstructed and open condition, in which it will easily receive the corresponding flange of the arrow quiver. (Of course, apertures 40', 42' may be plain and untapped, if desired, where the screws 44 and 46 are of the self-tapping variety.)

As previously noted, numerous other particular forms of mounting means 24 may be utilized in accordance with the invention, which is fully compatible with most commerically-available such devices. Primarily, the invention is intended for use with any such "mounting bracket" which incorporates a pair of spaced apertures 40 and 42 which are spaced apart the required distance (i.e., approximately one and one-quarter inches) to receive the now-standard mounting screws for "flat-type" bow sights, for which substantially all present-day compound bows are now factory-equipped with pre-drilled, tapped holes. Since this has now become standardized for bows and bow-sights, such mountings are also sometimes used for other purposes as well (for example, see prior U.S. Pat. No. 4,704,800) and they lend themselves very well to securing a quiver-mounting bracket on a bow. Hence, use of this aperture size and spacing on the body 26 for the screws 40 and 42 will enable they hunter to mount the same type of bracket on his hunting stand or blind as he uses on the bow itself, to directly and interchangeably accommodate the same quiver. Of course, as already indicated, in the broader aspects of the invention other types of mounting brackets may also be used, as many non-standard mounting screw placements or a combination of differently-positioned screw apertures from which a desired set could be selected.

Preferably, the screws 44 and 46 are installed in place before the hunter enters the field, although this may of course be done subsequently as well: by doing this before venturing out, however, the mounting bracket 24 in effect captures the lag screw or attachment member 28 and holds it in place, ready for use. With the lag or member 28 so captured, force may to be applied to the member 28 in the direction of the external support structure 14 (e.g., the tree trunk) at the same time that the support base is being rotated, to more readily drive the threaded lag screw or other such attachment member into the external support. Of course, other specific means of installation may also be utilized, e.g., the head 34 of the attachment member 28 may be impacted by any available and convenient hammering object in the field in order to slightly start the attachment member into the external support, whereupon the body 26 may be rotated in order to thread the attachment member into the tree trunk or the like without any particular amount of axially-directed force, particularly where the external support comprises a soft-wooded green tree (e.g., pine, cedar, or even birch) encountered in the field.

Figure 6:
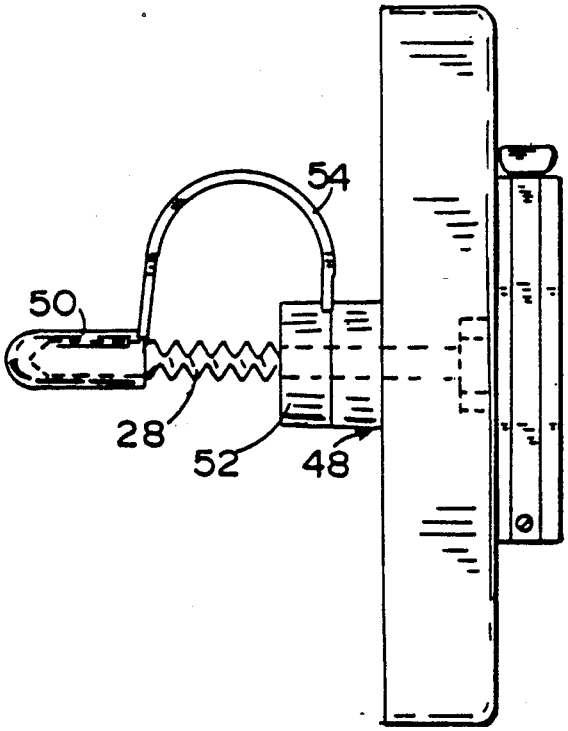
FIG. 6 is a side-elevational view of the structure shown in FIG. 5, in the configuration best suited for transport by the hunter.

Accordingly, in accordance with the novel apparatus provided herewith an easily-used, and readily reusable, arrow quiver-mounting apparatus is provided which may very conveniently be carried by the hunter into the field, installed, utilized, and removed at the end of a day's hunt. In order to facilitate carrying the device upon the person, particularly in the assembled configuration shown in FIG. 3, the invention further provides a protective means 48, which is generally illustrated in FIG. 3 and particularly illustrated in FIG. 6. More particularly, the protective means 48 preferably comprises a cap-like cover 50 which overlies the end of the lag screw or other such pointed attachment member 28 so as to prevent inadvertent contact therewith by the user. As illustrated in FIG. 6, the cap or cover 50 is preferably connected to an annular collar 52 by a short tether or connecting link 54. In this manner, the mounting ring 52 may have a diameter directly complementary to that of the end of the hub portion 30, so as to tightly fit over it, thereby in effect attaching the protective means 48 to the support base 22.

Preferably, the protective means 48 comprises an integrally-molded apparatus formed from any desired polymeric material, e.g., polyethylene or polyvinyl injection-moldable, and if the selected material has sufficient rigidity to make the connecting tether 54 a resiliently-deflectable leaf structure, the cap 50 may simply be removed from the pointed member 28 when the latter is to be installed, whereupon the tether will spring to a vertical position such as that shown in FIG. 3, holding the cover or cap out of the way for mounting of the apparatus upon the external support, but at the same time preventing inadvertent loss of the cover 50 and ensuring its availability for subsequent use when the mounting device is removed from the external support.

Accordingly, it will be seen that a novel and highly useful device for bow hunters is provided in accordance herewith, by which arrow-mounted and other such quivers may be mounted in a convenient place at a blind or stand for hunting purposes, and then subsequently demounted and carried with the hunter when he leaves that place of hunting. As may be appreciated, the preferred structure disclosed and described herein is efficient and economical to manufacture, and yet is reusable over an extended period, thereby facilitating its ownership and utilization by the hunter.

It is to be understood that the foregoing description of a preferred embodiment of the invention is provided for purposes of the description and illustration, and not as a measure of the invention, whose scope is to be defined by reference to the ensuing claims. Thus, while those skilled in the art may devise embodiments of the particular concepts presented in the foregoing illustrative disclosure which differs somewhat from the particular embodiment shown and described in detail herein, or may make various changes in structural details to the illustrated embodiment, all such alternative or modified embodiments which utilize the concepts of the invention and clearly incorporate the spirit thereof are to be considered as within the scope of the claims appended herebelow, unless such claims by their language specifically state otherwise.

The embodiments of the invention in which an exclusive property or privilege is claimed are defined as follows.

1. A portable and detachable, manually-installed field mount for arrow quivers, comprising in combination: a support base having a generally rigid body of elongated configuration and of a size and shape adapted to be held in the human hand; a pointed attachment member carried by said body and projecting transversely therefrom; said body including means defining a recess for receiving portions of said attachment member and for transmitting mounting forces to said attachment member generated by said hand, such that said pointed attachment member may be made to pierce and enter a desired supportive structure encountered in the field while hunting or the like to thereby manually secure the support base to such supportive structure without the need for supplemental tools or additional fastener devices; and an arrow quiver-mounting means adapted to be secured to said support base, said base and quiver-mounting means having complementary and cooperative structure for securing one to the other thereof, said quiver-mounting means adapted to removably receive corresponding portions of an arrow quiver to thereby removably mount such quiver upon said base.

2. A field mount for arrow quivers according to claim 1, and further including a protective cover overlying the end of said pointed attachment member.

3. A field mount for arrow quivers according to claim 1, wherein said pointed attachment member is removably carried by said body.

4. A field mount for arrow quivers according to claim 1, wherein said pointed attachment member comprises a threaded screw-like element having a head portion which includes engageable means for rotatably driving such element to thread it into a desired support found in the field, and wherein said body includes means for cooperatively engaging said engageable means to rotatably drive said screw-like element in a manner threadably mounting said body upon said desired support.

5. A field mount for arrow quivers according to claim 4, wherein said pointed attachment member is removably carried by said body.

6. A field mount for arrow quivers according to claim 4, and further including a protective cover overlying the end of said pointed screw-like element.

7. A field mount for arrow quivers according to claim 4, wherein said screw-like element comprises a lag bolt having an angularly-shouldered head, said body having a complementary angularly-shouldered recess for engaging and driving said head.

8. A field mount for arrow quivers according to claim 7, and further including a protective cover overlying the end of said pointed screw-like element.

9. A field mount for arrow quivers according to claim 8, wherein said protective cover is coupled to and carried with said support base.

10. A field mount for arrow quivers according to claim 1, wherein said support base comprises a dished member of molded configuration having a generally centrally-located hub portion, said hub portion comprising at least in part said means defining a recess for receiving portions of said attachment member and for transmitting mounting forces thereto.

11. A field mount for arrow quivers according to claim 10, wherein said pointed attachment member comprises a threaded screw-like element having a had portion which includes engageable means for rotatably driving such element to thread it into a desired support found in the field, and wherein said body includes means for cooperatively engaging said engageable means to rotatably drive said screw-like element in a manner threadably mounting said body upon said desired support, said hub portion comprising said means for cooperatively engaging said engageable means to rotatably drive said screw-like element.

12. A field mount for arrow quivers according to claim 11, wherein said screw-like element comprises a lag bolt having an angularly-shouldered head, said hub having a complementary angularly-shouldered recess for engaging and driving said head.

13. A field mount for arrow quivers according to claim 1, wherein said arrow quiver-mounting means includes an upwardly-opening slot and a downwardly-extending flange member receivable in and engageable with said slot to mount said quiver upon said base.

14. A field mount for arrow quivers according to claim 13, wherein said quiver-mounting means comprises a bracket member and means for securing said member to said body, said bracket member carrying one of said flange member and slot.

15. A field mount for arrow quivers according to claim 14, wherein said bracket member carries said slot and includes means for entrapping said flange member within said slot.

16. A field mount for arrow quivers according to claim 15, wherein said complementary and cooperative structure for securing said quiver-mounting bracket member to said support base comprises at least one pair of mutually aligned apertures for receiving a screw, and a screw extending through the same two aligned apertures.

17. A field mount for arrow quivers according to claim 16, wherein said complementary and cooperative structure comprises two sets of said aligned aperture pairs, said two sets being spaced a distance apart corresponding to that of the standard mounting holes provided on bows for mounting sights thereupon.

* * * * *